US008166683B2

(12) United States Patent
Cheetwood

(10) Patent No.: US 8,166,683 B2
(45) Date of Patent: May 1, 2012

(54) CARD HOLDER

(76) Inventor: Craig Cheetwood, Maumee, OH (US)

( * ) Notice: Subject to any disclaimer, the term of this patent is extended or adjusted under 35 U.S.C. 154(b) by 0 days.

(21) Appl. No.: 12/726,885

(22) Filed: Mar. 18, 2010

(65) Prior Publication Data

US 2010/0236111 A1 Sep. 23, 2010

Related U.S. Application Data

(60) Provisional application No. 61/161,623, filed on Mar. 19, 2009.

(51) Int. Cl.
*A47B 19/00* (2006.01)

(52) U.S. Cl. ..... 40/124; 40/124.4; 248/441.1

(58) Field of Classification Search ..... 40/124, 40/124.2

See application file for complete search history.

(56) References Cited

U.S. PATENT DOCUMENTS

| | | | | | |
|---|---|---|---|---|---|
| 805,895 | A * | 11/1905 | Wedderburn | 273/150 |
| 1,117,824 | A * | 11/1914 | Fleming | 211/69.9 |
| D204,889 | S * | 5/1966 | Gingher | D8/377 |
| 5,185,948 | A * | 2/1993 | Markson | 40/506 |
| 5,339,547 | A * | 8/1994 | Fogel | 40/124.01 |
| 5,560,131 | A * | 10/1996 | Gibson | 40/607.12 |
| 5,921,404 | A * | 7/1999 | Cooke et al. | 211/40 |
| 6,412,743 | B1 * | 7/2002 | Fell | 248/441.1 |
| 6,964,402 | B2 * | 11/2005 | Savalas | 248/441.1 |

* cited by examiner

*Primary Examiner* — Casandra Davis

(74) *Attorney, Agent, or Firm* — Fraser Clemens Martin & Miller LLC; J. Douglas Miller

(57) ABSTRACT

A card holder includes a unitary hollow main body having with a base portion, a first side, a second side, and a top portion. The first side and the second side are angled toward one another and coupled to the top portion. The base portion is coupled to at least one of the first side and the second side. At least one of the first side, the second side, and the top portion has a plurality of grooves formed therein. Each of the grooves has a depth sufficient to hold at least one card in a substantially upright position.

2 Claims, 3 Drawing Sheets

CARD HOLDER

CROSS-REFERENCE TO RELATED APPLICATIONS

This application claims the benefit of U.S. Provisional Patent Application No. 61/161,623, filed on Mar. 19, 2009. The entire disclosure of the above application is hereby incorporated herein by reference.

FIELD OF THE INVENTION

The present disclosure relates to card holders, and more particularly, to a card holder for organizing and displaying business cards and the like.

BACKGROUND OF THE INVENTION

It is typical in business for an individual to receive numerous contacts and related business cards during a day or a week. The individual generally needs to make follow-up phone calls or send e-mail messages to persons identified by the business cards. However, conventional business card holders such as rolodexes and other filing devices are known to be cumbersome, and can lead to the individual forgetting to follow up with the contact.

The placement of business cards on a computer keyboard is often conducted as a reminder to the individual. Post-it notes on a computer are also sometimes used as the reminder. However, such practices are disorganized and undesirably limit the individual's use of the computer keyboard as the number of cards increase.

There is a continuing need for a card holder that facilitates greater productivity of the individual with many contacts, and allows the individual to readily view the business cards as a reminder that the individual needs to follow up with the contacts. Desirably, the card holder may also be used in a kitchen to hold recipe cards, in a school to hold math flash cards and alphabet flash cards, and to help school children with computer keyboarding.

SUMMARY OF THE INVENTION

In concordance with the instant disclosure, a card holder that helps make the individual with many contacts more productive, allows the individual to readily view the business cards as a reminder that the individual needs to follow up with the contacts, and which may also be used in the kitchen to hold recipe cards, in a school to hold math flash cards and alphabet flash cards, and to help school children with computer key boarding, is surprisingly discovered.

In an exemplary embodiment, the card holder is designed as a single uniform elongated piece of resilient plastic. The card holder has a flat base with two sides that slant toward each other to make a flat area on the top with grooves. The grooves are deep enough so that the cards that are placed in them will not tip forward and fall out. The plastic is light weight, yet strong enough to be self supporting. Being formed from light weight, resilient plastic, the card holder is readily portable.

The card holder also has grooves on both sides that are approximately three-eighths of an inch (⅜") in depth. The business cards, file cards or other cards that are placed in the grooves are thereby permitted to stand substantially upright for viewing. Each side of the card holder has multiple grooves, for example, up to about ten grooves per side. The grooves run the entire length of each side and allow the cards to be identified by the user.

The card holder may be provided in a variety of different colors. The card holder may be opaque or transparent. It should be appreciated that the card holder does not need to be transparent because only a small portion of the business card, file card or other card is inserted within the groove. The card holder does not have any spacers or partitions within the individual grooves, and thereby allows inserted cards to overlap one another, as desired.

The card holder helps make an individual who works at their computer more productive. However, the card holder can also be used in the kitchen to hold recipe cards, or in schools to hold math flash cards and alphabet flash cards, and to help children with computer keyboarding. The card holder is particularly suited for someone that makes numerous contacts during the day or week, and needs to make follow up calls or e-mails, and doesn't want to forget about the contacts. The card holder allows the user to view business cards as a reminder that follow up with the contacts is required. The card holder may be provided in a variety of different lengths, for example, a fourteen inch (14") length that holds up to about twenty-four (24) business cards full face, and a seven inch (7") length that hold up to about twelve (12) business cards full face. The card holder also permits the user to overlap cards, as desired.

The card holder militates against the practice of placing business cards on the user's keyboard, where at times they can become unorganized and make the computer keys stick if to many cards are placed between the keys. The card holder also militates against the undesirable placement of post-it notes on a computer monitor. The card holder can be placed between the keyboard and the computer monitor for the user having a desktop computer, or to the side of the computer if the user has a laptop.

Other applications for the card holder include schools and institutions for special needs students. Many times children with ADHD have a difficult time focusing on the task at hand. Even looking off to the side while trying to look at information that they need to type can be distracting. The card holder can hold file cards with information that needs to be typed by the student right in front of them (positioned between the keyboard and monitor) so the student does not have to look away from their work. The line of sight is thereby not compromised, thus making it easier for the student to focus and facilitate learning.

In a first embodiment, a card holder includes a unitary hollow main body having a base portion, a first side, a second side, and a top portion. The first side and the second side are angled toward one another and coupled to the top portion. The base portion is coupled to at least one of the first side and the second side. At least one of the first side, the second side, and the top portion has a plurality of grooves formed therein. Each of the grooves has a depth sufficient to hold at least one card in a substantially upright position.

In another embodiment, the base portion of the card holder is substantially planar and includes a first base portion coupled with the first side and a second base portion coupled with the second side. The first base portion is spaced apart from the second base portion and defines an opening therebetween.

In a further embodiment, the card holder includes a pair of end caps disposed at opposing ends of the hollow main body. Each of the end caps has a raised portion that is received by the opening between the first base portion and the second base portion.

DRAWINGS

The above, as well as other advantages of the present disclosure, will become readily apparent to those skilled in the art from the following detailed description, particularly when considered in the light of the drawings described herein.

DETAILED DESCRIPTION OF THE INVENTION

Figure 1:
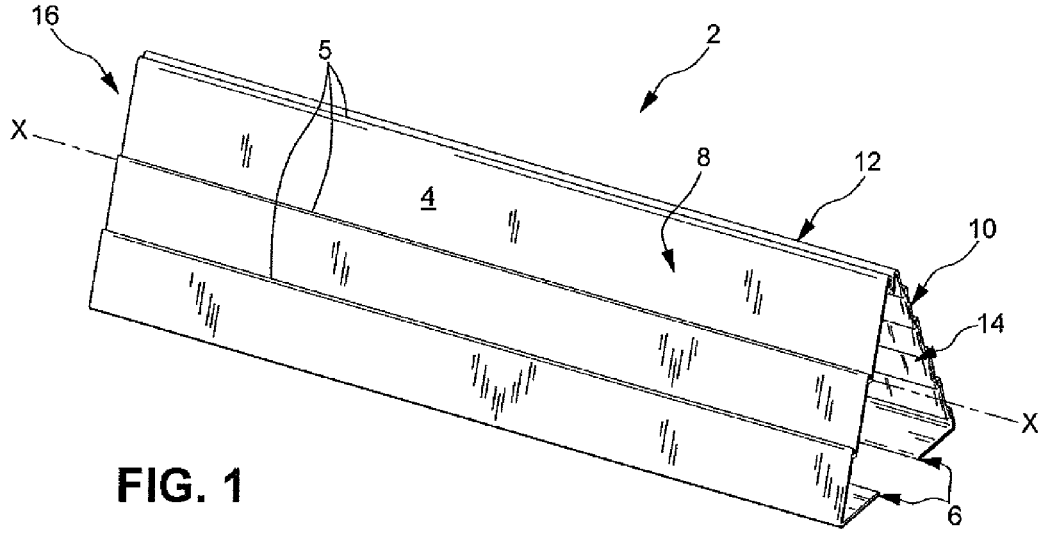
FIG. 1 is a rear perspective view of a card holder according to an embodiment of the present disclosure.
Figure 2:
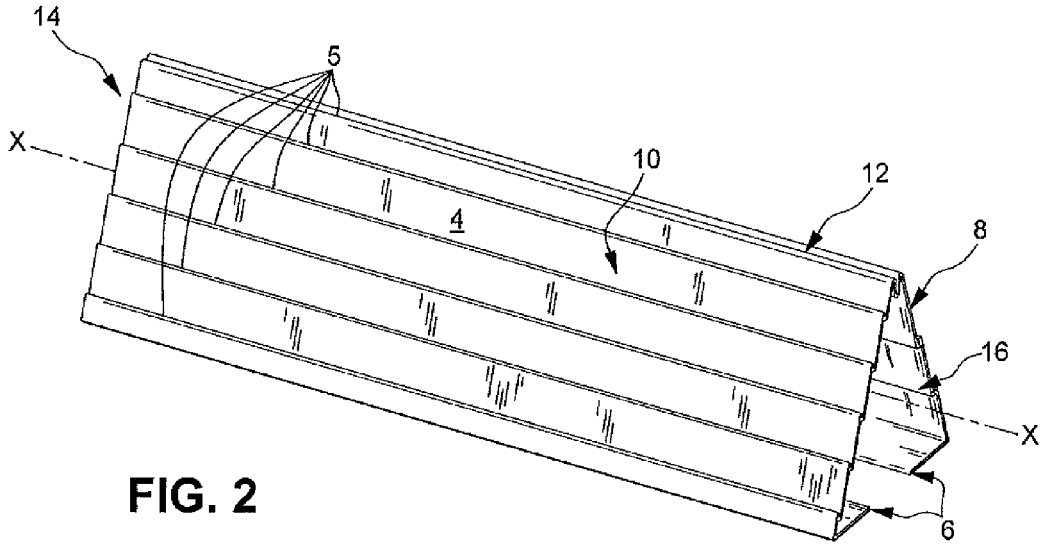
FIG. 2 is a front perspective view of the card holder shown in FIG. 1.
Figure 3:
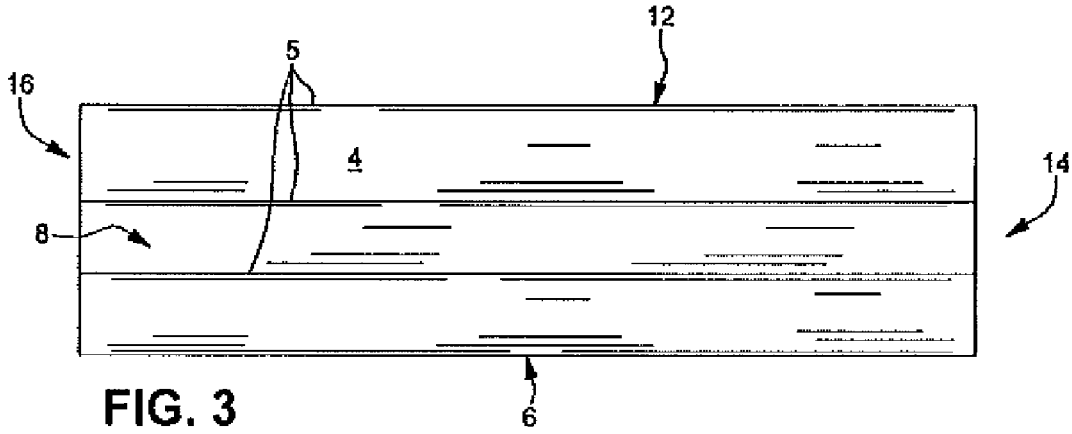
FIG. 3 is a rear elevational view of the card holder shown in FIGS. 1-2.
Figure 4:
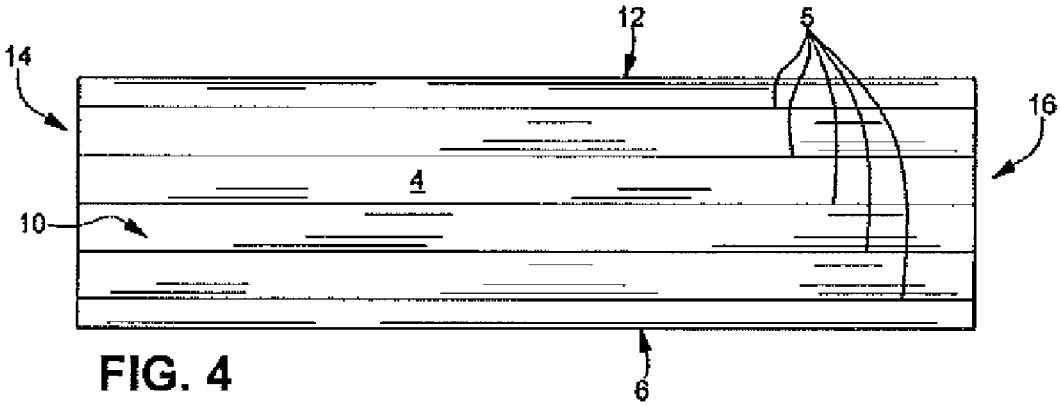
FIG. 4 is a front elevational view of the card holder shown in FIGS. 1-3.

The following detailed description and appended drawings describe and illustrate various embodiments of the invention. The description and drawings serve to enable one skilled in the art to make and use the invention, and are not intended to limit the scope of the invention in any manner.

As shown in FIGS. 1-6, the present disclosure includes a card holder 2 having a unitary, hollow main body 4. The main body 4 has a base portion 6, a first side 8, a second side 10, and a top portion 12. The first side 8 and the second side 10 are angled toward one another and coupled to the top portion 12. The base portion 6 is coupled to at least one of the first side 8 and the second side 10. At least one of the first side 8, the second side 10, and the top portion 12 has a plurality of grooves 5 formed therein. Each of the grooves 5 is configured to hold at least one card (not shown) in a substantially upright position.

In a particular embodiment, the main body 4 is a one-piece plastic extrusion. In other embodiments, the main body 4 is molded plastic or rubber material. The main body 4 may be elongated and extend along a longitudinal axis X thereof. The material and the wall thicknesses selected for the main body 4 provide a stiffness sufficient to support many cards without bending the main body 4. As a nonlimiting example, the main body 4 may be formed from an extruded polyvinyl chloride material. One of ordinary skill may select other suitable materials and manufacturing processes for the main body 4, as desired.

The hollow main body 4 of the card holder 2 has a first open end 14 and a second open end 16. The first and second open ends 14, 16 of the hollow main body 4 advantageously permit a user to store items such as additional business cards, writing utensils, and the like. It should also be appreciated that, by being hollow and open ended, the manufacturing costs for the hollow main body 4 may be significantly less than would otherwise be for a substantially solid body.

In a particular example, the hollow main body 4 has one of a substantially trapezoidal cross-section and a substantially triangular cross-section. The cross-sections are taken along a plane that is substantially orthogonal to a vertical plane along the longitudinal axis X of the hollow main body 4. Where the main body 4 has a substantially trapezoidal cross-section, the top portion 12 and the base portion 6 may be substantially parallel with one another. In other examples, the top portion 12 and the base portion 6 may be not parallel, i.e., angled with respect to one another.

The grooves 5 of the card holder 2 are disposed along substantially an entire length of the main body 4. In a particular embodiment, the grooves 5 are formed in each of the first side 8, the second side 10, and the top portion 12 of the main body 4. The first side 8 may have a first quantity of the grooves 5, and the second side 10 may have a second quantity of the grooves 5. The first and second quantities of grooves 5 may be the same or different, as desired. For example, the first quantity of grooves 5 is less than the second quantity of grooves 5. In a particular example, the first quantity of grooves 5 is less than half the second quantity of grooves 5. The different quantities of grooves 5 on the first side 8 and the second side 10 may facilitate the use of the card holder 2 with a variety of differently sized cards.

As shown in FIGS. 1-6, the top portion 12 may have a single one of the grooves 5 formed along the entire length of the main body 4. The single groove 5 of the top portion 12 may have a depth 26 greater than a depth 24 of the other grooves, and thereby facilitate the use of the groove 5 of the top portion 12 with larger cards. It should be understood that the top portion 12 having multiple grooves 5 is also within the scope of the present disclosure.

Figure 5:
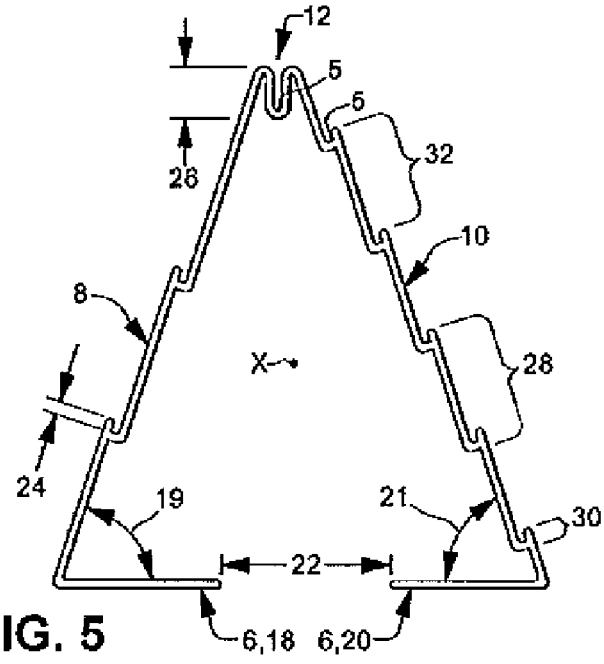
FIG. 5 is an end elevational view of the card holder shown in FIGS. 1-4.
Figure 6:
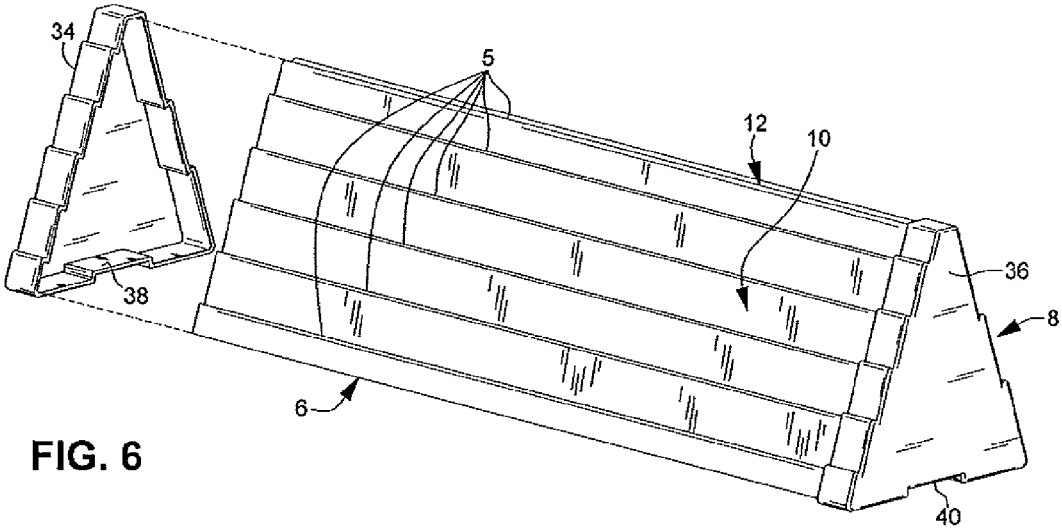
FIG. 6 is a front perspective view of the card holder shown in FIGS. 1-5, further showing a pair of caps disposed over open ends of the card holder.

As shown in FIG. 5, the base portion 6 of the hollow main body 4 is substantially planar, although other configurations can be used. The base portion 6 is broader than the top portion 12 so as to permit a stable placement of the card holder 2 upon a support surface such as a desktop. The substantially planar base portion 6 may further have a non-slip surface provided by a texture such as an embossing formed on the substantially planar base portion 6. The texture may be formed, for example, by a roller disposed at an end of the extruder from which the hollow main body 4 is extruded. Foam pads or other structure may also be used to provide the non-slip surface.

In an illustrative embodiment, the base portion 6 includes a first base portion 18 and a second base portion 20. The first base portion 18 is coupled with the first side 8 and the second base portion 20 is coupled with the second side 10. The first side 8 angles upwardly and inward at a first angle 19 from the first base portion 18. The second side 10 angles upwardly and inward at a second angle 21 from the second base portion 20. The first angle 19 and the second angle 21 may be substantially the same. In certain embodiments, the first angle 19 is greater than the second angle 21. The first and second angles 19, 21 may be selected based upon the desired application for the card holder, for example, with a lower angle employed where larger or taller cards will be used. The first base portion 18 is spaced apart from the second base portion 20. The first base portion 18 and the second base portion 20 thereby define an opening 22 therebetween.

As further shown in FIG. 5, the grooves 5 in the card holder 2 of the present disclosure have the depth 24 that is sufficient to hold the at least one card in the substantially upright position. Favorable results have been obtained where the depth 24 of the grooves 5 is at least three-eighths of an inch (⅜"). The grooves 5 having the depth 24 of at least three-eighths of an inch (⅜") militate against an undesirable tipping or falling over of the at least one card. The depth 24 of about three-eighths of an inch (⅜") advantageously holds the at least one card in the substantially upright position, while permitting the user of the card holder 2 to view the portion of the card where content such as names, addresses, and phone numbers are most likely provided.

The first side 8 and the second side 10 may include a plurality of substantially J-shaped segments 28 that define the grooves 5. The J-shaped segments 28 include a lower portion 30 and an upper portion 32. The lower portion 30 of at least one of the J-shaped segments 28 is integral with the upper portion 32 of another one of the J-shaped segments 28. The integral plurality of J-shaped segments 28 forms the first side 8 and the second side 10 of the card holder 2. The lowest ones of the J-shaped segments 28 on the first side 8 and the second side 10 of the hollow main body 4 are coupled with the base portion 6, and particularly with the respect first base portion 18 and the second base portion 20.

In a further embodiment, the card holder 2 of the present disclosure may include first and second end caps 34, 36 disposed at the opposing first and second ends 14, 16 of the hollow main body 4. The first and second end caps 34, 36 may have substantially the same shape as the cross-sectional shape of the hollow main body 4. The first and second caps 34, 36 are configured to slide over the respective first and second ends 14, 16 of the hollow main body 4. Each of the first end cap 34 and the second end cap 36 may also have a raised portion 38, 40 that is received by the opening 22 between the first base portion 18 and the second base portion 20. It should be understood that the first and second caps 24, 26, as well as the raised portions 38, 40, may stabilize the hollow main body 4. The first and second caps 24, 26 also facilitate a secure storage of items in the hold main body 2

Advantageously, the card holder 2 of the present disclosure assists in optimizing a productivity of a user with multiple contacts. The card holder 2 allows the user to readily view the business cards as a reminder that the user needs to follow up with the contacts. It is further surprisingly found that the card holder 2 is useful in a kitchen for holding recipe cards, and in a school for holding math flash cards and alphabet flash cards. In particular, the card holder 2 helps school children who are practicing computer key boarding by holding up cards having the text to be typed thereon.

While certain representative embodiments and details have been shown for purposes of illustrating the invention, it will be apparent to those skilled in the art that various changes may be made without departing from the scope of the disclosure, which is further described in the following appended claims.

What is claimed is:

1. A card holder comprising:

a unitary hollow main body having with a base portion, a first side, a second side, and a top portion, the first side and the second side angled toward one another and coupled to the top portion, the base portion coupled to at least one of the first side and the second side, wherein the base portion is substantially planar and includes a first base portion coupled with the first side and a second base portion coupled with the second side, the first base portion spaced apart from the second base portion to define an opening therebetween, and wherein at least one of the first side and the second side has a plurality of grooves formed therein, each of the grooves having a depth sufficient to hold at least one card in a substantially upright position; and a pair of end caps disposed at opposing first and second ends of the hollow main body, where each of the end caps has a raised portion that is received by the opening between the first base portion and the second base portion.

2. A card holder comprising:

a unitary hollow main body having with a base portion, a first side, a second side, and a top portion, the first side and the second side angled toward one another and coupled to the top portion, the base portion coupled to at least one of the first side and the second side, wherein at least one of the first side and the second side has a plurality of grooves formed therein, each of the grooves having a depth sufficient to hold at least one card in a substantially upright position, wherein the first side and the second side include a plurality of substantially J-shaped segments that define the grooves, a lower portion of one of the J-shaped segments integral with an upper portion of another of the J-shaped segments.

* * * * *